US008820101B2

(12) United States Patent
Hausmann et al.

(10) Patent No.: US 8,820,101 B2
(45) Date of Patent: Sep. 2, 2014

(54) REFRIGERATOR WITH FORCE-VENTILATION CONDENSER

(75) Inventors: Georg Hausmann, Blindheim (DE); Hans Ihle, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 955 days.

(21) Appl. No.: 12/310,339

(22) PCT Filed: Aug. 7, 2007

(86) PCT No.: PCT/EP2007/058161

§ 371 (c)(1), (2), (4) Date: Feb. 20, 2009

(87) PCT Pub. No.: WO2008/025648

PCT Pub. Date: Mar. 6, 2008

(65) Prior Publication Data

US 2009/0241567 A1 Oct. 1, 2009

(30) Foreign Application Priority Data

Aug. 29, 2006 (DE) ..... 10 2006 040 379

(51) Int. Cl.
*F25D 17/00* (2006.01)
*F28D 5/00* (2006.01)
*F25D 17/06* (2006.01)

(52) U.S. Cl.
USPC ..... 62/181; 62/305; 62/428

(58) Field of Classification Search
USPC ..... 62/179, 186, 181, 305, 314, 428
See application file for complete search history.

(56) References Cited

U.S. PATENT DOCUMENTS

| | | | | |
|---|---|---|---|---|
| 5,592,829 | A * | 1/1997 | Kim | 62/428 |
| 5,657,638 | A * | 8/1997 | Erdman et al. | 62/182 |
| 5,711,159 | A * | 1/1998 | Whipple, III | 62/82 |
| 5,918,474 | A * | 7/1999 | Khanpara et al. | 62/179 |
| 6,598,410 | B2 * | 7/2003 | Temmyo et al. | 62/179 |
| 6,779,353 | B2 * | 8/2004 | Hu et al. | 62/180 |
| 7,005,983 | B2 * | 2/2006 | Holmes et al. | 340/545.6 |
| 2002/0134095 | A1 | 9/2002 | Temmyo et al. | |
| 2006/0185373 | A1 * | 8/2006 | Butler et al. | 62/181 |

FOREIGN PATENT DOCUMENTS

| | | | |
|---|---|---|---|
| CN | 1743775 | A | 3/2006 |
| DE | 4220503 | A1 | 1/1994 |
| JP | 11183016 | A | 7/1999 |
| WO | 2004015342 | A1 | 2/2004 |
| WO | WO 2004015342 | A1 * | 2/2004 |
| WO | 2006087690 | A2 | 8/2006 |

OTHER PUBLICATIONS

Foreign Patent Office Report—CN, Apr. 2011.

* cited by examiner

*Primary Examiner* — Chen Wen Jiang
(74) *Attorney, Agent, or Firm* — Nixon & Vanderhye, P.C.

(57) ABSTRACT

A refrigerator with a condenser and a fan for the forced ventilation of the condenser, the refrigerator including a fan control circuit for controlling the fan to provide variable throughflow of air from the fan and an assembly for measuring temperature in operative communication with the fan control circuit for operating the fan in a temperature-dependent manner.

6 Claims, 1 Drawing Sheet

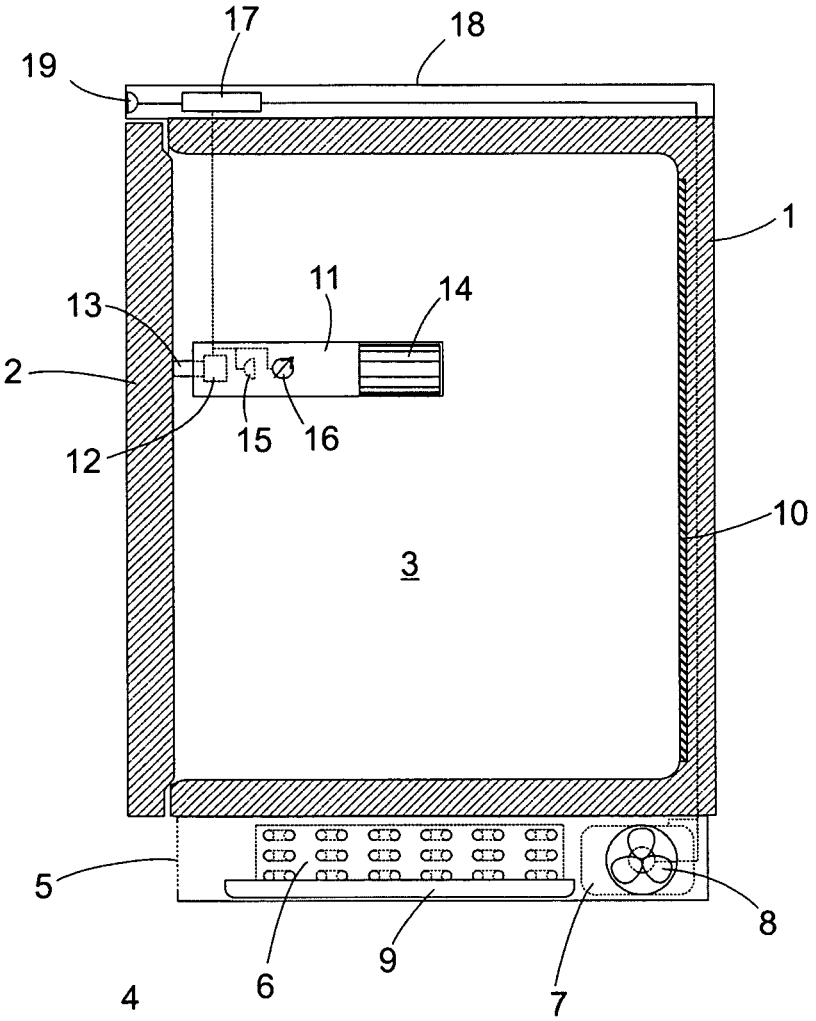
17
18
19
1
11
14
13
2
15
16
12
10
3
5
8
6
9
7
4

REFRIGERATOR WITH FORCE-VENTILATION CONDENSER

BACKGROUND OF THE INVENTION

The present invention relates to a refrigerator with a condenser, which is forcedly ventilated by a fan.

The storage space of such a refrigerator is usually cooled with the aid of a compressor, which is switched on and off as a function of the temperature detected by a sensor attached to the storage space. The performance of the compressor in the switched-on state is not regulated, a long-term regulation of the cooling power is performed by way of the ratio of the operating time of the compressor to the overall operating time of the refrigerator.

Waste heat is only produced during the operating time of the compressor, said waste heat having to be output at the condenser to the environment. If the condenser is forcedly ventilated by a fan, the fan is thus usually switched on and off together with the compressor.

While the operating noise of the compressor can be suitably shielded by means of muffling and vibration-free mounting, the sound insulation of the fan may bring about problems, since the flow noises of the air cooling the condenser pass through this air into the atmosphere. The sound volume of the flow noises significantly increases with the flow speed and in order to ensure an adequate cooling of the condenser, including in the case of a significant heat input into the refrigerator, the flow speed of the forced ventilation must not be set too low.

BRIEF SUMMARY OF THE INVENTION

The object of the invention is to specify a refrigerator with a condenser and a fan for the forced ventilation of the condenser, in which the noise development is at least temporarily reduced by the fan.

This object is achieved in accordance with the invention such that a control circuit of the fan variably controls the throughflow thereof in a temperature-dependent fashion. The air throughflow can be variably adjusted by varying the fan speed for instance. Furthermore, it may also be conceivable for the control of the air throughflow for the volume of air conveyed by the fan to be divided into subvolumes, one or several of which are conveyed by way of the condenser. A temperature-dependent pulsing of the fan is also possible in order to control the air throughflow.

The ambient temperature of the refrigerator can be used as a temperature on the basis of which the throughflow is controlled.

Alternatively or in addition, the actual temperature or the target temperature of an interior compartment of the refrigerator can also be used.

The control circuit can also be connected to a sensor for detecting the opening of the door and can control the throughflow of the fan as a function of a detected opening of the door. In this way, it is assumed that a significant heat input into the interior compartment of the refrigerator can only occur if the door is opened, so that only on the understanding that the door has been opened, may it be necessary for the fan to be operated with a high throughflow, while on the other hand, a lower, less significant noise-inducing throughflow is sufficient.

BRIEF DESCRIPTION OF THE DRAWINGS

Further features and advantages of the invention result from the description of an exemplary embodiment which follows, with reference to the appended FIGURE.

These show a schematic section through an inventive refrigerator.

The refrigerator shown in FIG. 1 has a carcass 1 and a door 2, which surround a heat-insulated interior compartment 3. The carcass 1 rests on a hollow, cuboid base 4, which is subdivided into two spaces by a separating wall which is parallel to the sectional plane in the Fig. Ventilation openings 5 for the entry/exit of cooling air are formed in a front wall of the base 4, below the door 2. The cooling air firstly reaches the rear space of the base 4 (shown in the perspective view in the Fig.), in which a condenser 6 and compressor 7 are located, concealed by the separating wall and thus shown as a dashed outline.

DETAILED DESCRIPTION OF THE PRESENT INVENTION

A fan 8 is mounted in an opening of the separating wall, said fan powering a flow of cooling air from the rear into the front space of the base 4, through which the plane of the section passes. This front space contains an evaporation dish 9, into which the condensation water settling in the interior compartment 3 is fed.

A refrigerant circuit (not shown in detail in the Fig.) passes in a manner known per se from the compressor 7 via the condenser 6 to an evaporator 10 in the rear wall of the carcass 1 and attached so as to be in thermal contact with the interior compartment 3 and passes from there back to the compressor 7.

A lighting module 11 is mounted on a side wall of the carcass 1 in the interior compartment 3. The lighting module 11 contains a switch 12, which can be actuated by a switch push rod 13 which can be moved in contact with the door 2 and is to detect the opening status of the door 2 and to switch on an illuminant mounted behind a transparent screen 14 when the door 2 is open and to switch it off when the door 2 is closed.

The lighting module 1 also contains a temperature sensor 15 for detecting the temperature of the interior compartment 3 and a temperature controller 16, on which a user is able to adjust a target temperature of the interior compartment 3.

The switch 12, temperature sensor 15 and temperature regulator 16 are connected to a control circuit 17, which is accommodated in a cavity of a worktop 18 mounted on the carcass 1 in the case of the example shown here. A further temperature sensor 19 connected to the control circuit 17 is attached adjacent to an exterior surface of the worktop 18 in order to detect the ambient temperature of the refrigerator. The control circuit 17 could naturally be accommodated in any other suitable cavity in the device, in particular in the base 4, and the temperature sensor 19 could be arranged in the rear space of the base 4 between the ventilation openings 5 and the compressor 6 for instance in order to detect the temperature of the inflowing cooling air before this heats up at the condenser 6.

The control circuit 17 is connected to the compressor 7 in order to switch this on and off as a function of the actual temperature of the interior compartment 3 detected on the temperature sensor 15 and the target temperature adjusted on the temperature controller 16.

The control circuit 17 is also connected to the fan 8 in order to switch this on and off in a temporally correlated fashion with the compressor 7.

The temporal correlation may in the simplest case be a concurrence; it is however also conceivable for the fan 8 to be switched on and/or off with a certain delay in respect of the compressor 7 in each instance so that in an initial phase of the compressor operation, in which no appreciable waste heat power accumulates on the condenser 6, this is not forcedly cooled and/or in an after-run phase after switching off the compressor 7, residual heat, which is still stored in the condenser 6, is discharged from there and is as a result removed from the refrigerant circuit.

The higher the ambient temperature detected by the temperature sensor 19, the higher the speed of the fan 8 set by the control circuit 17. A relatively noise-intensive operation of the fan 8 can thus be exclusive to situations in which a high ambient temperature results in a significant heat input into the interior compartment 3 and correspondingly also in a high waste heat power to be discharged from the condenser 6. In the case of lower ambient temperatures, a fan speed 8, which is reduced in respect thereof, results in reduced flow noises and in a reduced power consumption of the refrigerator.

The speed regulation may take place on the basis of the detected ambient temperature alone; alternatively, the target or actual temperature of the interior compartment 3 may also be considered, particularly by taking the difference between this and the ambient temperature, since the heat inflow into the interior compartment 3 does not depend on the ambient temperature alone but instead on the temperature difference between the environment and the interior compartment 3.

A further refinement can be provided in that the control circuit 17 also evaluates the opening state of the door 2 by way of the switch 12 and the fan 8, in the event that an opening of the door 2 is observed between a current and the preceding operating phase of the compressor 7, sets a higher speed of the fan 8 than if such an opening of the door had not taken place.

The invention claimed is:

1. A refrigerator with a condenser, a compressor and a fan for the forced ventilation of the condenser, the refrigerator comprising:

a fan control circuit for controlling the fan, the control circuit being configured to selectively delay fan operation and to terminate fan operation based on compressor operation and to provide variable throughflow of air from the fan by controlling fan speed; and an assembly for measuring ambient refrigerator temperature in operative communication with the fan control circuit for operation of the fan by the fan control circuit based on the ambient temperature of the refrigerator wherein fan speed varies directly with ambient temperature of the refrigerator, wherein the refrigerator includes a door and the control circuit is configured to evaluate when the door is opened and to control fan speed based on the door being opened between successive compressor operations.

2. The refrigerator according to claim 1 wherein the control circuit controls the throughflow of air on the basis of at least one of the actual temperature or the target temperature of an interior compartment of the refrigerator.

3. The refrigerator according to claim 1 wherein the condenser is embodied in the form of a condenser wound in the form of a spiral and disposed in a base chamber of a base located below the refrigeration chamber of the refrigerator.

4. The refrigerator according to claim 1 and further comprising a data memory for storing fan speed stages, the data memory being in operative communication with the control circuit wherein the control circuit is configured for controlling the speed of the fan based on the speed stages stored in the data memory, said speed stages being adjusted in accordance with the ambient temperature of the refrigerator detected by the assembly for measuring temperature.

5. The refrigerator according to claim 1 wherein the control circuit is configured to control the throughflow of air based on the difference between one of the actual temperature and the target temperature of an interior compartment of the refrigerator and the ambient temperature of the refrigerator.

6. The refrigerator according to claim 1 wherein the control circuit is configured to control the throughflow of air by operating the fan in a pulsing manner.

* * * * *